US006354658B1

(12) United States Patent
Sher et al.

(10) Patent No.: US 6,354,658 B1
(45) Date of Patent: Mar. 12, 2002

(54) ARM CHAIR MOUNTED KEYBOARD SUPPORT APPARATUS

(76) Inventors: Michael L. Sher, 9311 Benthos St., Houston, TX (US) 77083; Jim Sher, 5406 Brook Bend, Sugarland, TX (US) 77479

( * ) Notice: Subject to any disclaimer, the term of this patent is extended or adjusted under 35 U.S.C. 154(b) by 0 days.

(21) Appl. No.: 09/558,677

(22) Filed: Apr. 26, 2000

(51) Int. Cl.[7] ..... A47C 7/68; A47B 83/02

(52) U.S. Cl. ..... 297/188.14; 297/148; 297/149; 297/153; 248/918

(58) Field of Search ..... 297/188.14, 148, 297/149, 153; 248/222.13, 229.21, 231.31, 298.1, 118, 918; 108/152

(56) References Cited

U.S. PATENT DOCUMENTS

| | | | | | |
|---|---|---|---|---|---|
| 2,937,694 | A | * | 5/1960 | Willson et al. | 297/153 |
| 3,083,053 | A | * | 3/1963 | Dorsey | 297/188.14 X |
| 3,121,591 | A | * | 2/1964 | Micciche | 297/153 |
| 3,146,738 | A | * | 9/1964 | Telarico | 297/148 X |
| 3,278,225 | A | * | 10/1966 | Stine | 297/148 |
| 3,538,522 | A | * | 11/1970 | Adams | 297/153 |
| 4,632,451 | A | * | 12/1986 | Lee | 297/153 |
| 5,131,715 | A | * | 7/1992 | Balles | 297/148 X |
| 5,356,059 | A | | 10/1994 | Yanez et al. | 224/42 |
| 5,836,562 | A | * | 11/1998 | Danzyger et al. | 248/918 X |
| 5,893,607 | A | | 4/1999 | Trimmell | 297/176 |
| 6,045,179 | A | * | 4/2000 | Harrison | 248/918 X |
| 6,092,774 | A | * | 7/2000 | Choy | 248/918 |

* cited by examiner

*Primary Examiner*—Jose V. Chen
*Assistant Examiner*—Rodney B. White
(74) *Attorney, Agent, or Firm*—Frank L. Kubler

(57) ABSTRACT

A chair arm-mounted tray apparatus for mounting on chair arms of a chair having a chair seat, for supporting an item includes an item support deck for supporting an item; and a deck support frame fastened to the support deck, the deck support frame having a chair arm engaging mechanism for removably securing the apparatus to the arms of a chair; so that the deck support frame positions the deck forwardly of the chair at an adjustable height and at an adjustable orientation relative to horizontal. The deck support frame preferably includes two parallel and laterally spaced apart telescoping frame arms removably secured to the chair arms by the chair arm engaging mechanism, the frame arms each having a frame arm forward end adjacent to the deck and a frame arm rearward end adjacent to the chair. The deck support frame alternatively includes at least one telescoping frame arm removably secured to a chair arm by the chair arm engaging mechanism, the frame arm having a frame arm forward end adjacent to the deck and a frame arm rearward end adjacent to the chair.

19 Claims, 14 Drawing Sheets

ARM CHAIR MOUNTED KEYBOARD SUPPORT APPARATUS

BACKGROUND OF THE INVENTION

1. Field of the Invention

The present invention relates generally to the field of computers and computer accessories. More specifically the present invention relates to a chair arm-mounted tray apparatus for supporting an item such as a keyboard in front of a user seated on a chair. The tray apparatus includes a panel defining a support deck on which the item is placed and a deck support frame fastened to the deck, the deck support frame having chair arm engaging means which removably secures the apparatus to the arms of a chair. The support frame positions the deck forwardly of the chair at an adjustable height and at an adjustable orientation relative to horizontal for ergonomic positioning of user arms and hands while the user operates a computer keyboard or mouse resting on the deck.

The deck support frame includes parallel and laterally spaced apart telescoping frame arms removably secured to chair arms by the chair arm engaging means. The chair arm engaging means preferably takes the form of first and second arm straddles in the form a U-shaped member defining a pair of spaced apart straddle tines. The straddle tines fit around each chair arm, pointing outwardly from the middle of the chair. As the frame arms pivot downwardly with their own weight as well as the weight of the deck and supported item, the tines rotate into abutting contact with the upper and lower surfaces of each chair arm, stopping further frame arm pivoting and thus supporting the frame arms and deck as the chair arms project forwardly and upwardly from the seat of the chair. Each arm straddle includes a clutch pivot joint at which the arm straddle engages the adjacent frame arm.

2. Description of the Prior Art

There have been various tray devices for connecting to or hanging from existing structures for supporting a wide variety of items, such as food at a drive-in restaurant. An example of a chair attached computer keyboard holder is found in Trimnell, U.S. Pat. No. 5,893,707, issued on Apr. 13, 1999. A problem with Trimnell is that it connects to a only certain type of chair legs not found on many chairs and is apt to be bumped by user feet. Another example is that of Yancz, et al., U.S. Pat. No. 5,356,059, issued on Oct. 18, 1994 for a basket or tray for attachment to a wheelchair. Once again, the attachment means appear to require the structure of a wheelchair, making its use very limited in the business world.

It is thus an object of the present invention to provide an arm chair mounted item support apparatus which can be removably secured to the chair arms so that an item supporting tray is in front of a seated user.

It is another object of the present invention to provide such an apparatus which includes means for altering and selecting the tray elevation and forward tray distance from the user.

It is still another object of the present invention to provide such an apparatus which includes means for altering and selecting the tilt of the tray forwardly or rearwardly for ergonomic use.

It is finally an object of the present invention to provide such an apparatus which is light weight, compact to store and transport, sturdy and inexpensive to manufacture.

SUMMARY OF THE INVENTION

The present invention accomplishes the above-stated objectives, as well as others, as may be determined by a fair reading and interpretation of the entire specification.

A chair arm-mounted tray apparatus is provided for mounting on chair arms of a chair having a chair seat, for supporting an item, including an item support deck for supporting an item; and a deck support frame fastened to the support deck, the deck support frame having a chair arm engaging mechanism for removably securing the apparatus to the arms of a chair; so that the deck support frame positions the deck forwardly of the chair at an adjustable height and at an adjustable orientation relative to horizontal.

The deck support frame preferably includes two parallel and laterally spaced apart telescoping frame arms removably secured to the chair arms by the chair arm engaging mechanism, the frame arms each having a frame arm forward end adjacent to the deck and a frame arm rearward end adjacent to the chair. The deck support frame alternatively includes at least one telescoping frame arm removably secured to a chair arm by the chair arm engaging mechanism, the frame arm having a frame arm forward end adjacent to the deck and a frame arm rearward end adjacent to the chair. The chair arm engaging mechanism preferably includes first and second arm straddles, each configured as a substantially U-shaped member defining a pair of spaced apart straddle tines; so that the straddle tines fit around each chair arm, facing generally outwardly from the middle of the chair, and so that the frame arms pivot downwardly with their own weight and the weight of the deck and thereby the tines rotate into abutting contact with upper and lower surfaces of each chair arm, stopping further frame arm pivoting and thus supporting the frame arms and the deck.

Each arm straddle preferably includes a clutch pivot joint at which the given the arm straddle engages the adjacent frame arm, each clutch pivot joint including a threaded straddle shaft extending from each arm straddle toward the opposing arm straddle and a straddle clutch disk facing toward the opposing arm straddle, each frame arm having a chair end including a shaft port for receiving and passing the adjacent straddle shaft, and having a clutch surface facing the adjacent straddle clutch disk; and a straddle nut screwed onto each threaded straddle shaft until the frame arm chair end clutch surface firmly abuts and engages the corresponding straddle clutch disk, preventing relative rotation between each frame arm and each arm straddle; so that the angle of the frame arms relative to horizontal can be adjusted as needed by the user by loosening the straddle nuts enough that the clutch surface and the clutch disk of each arm straddle disengages to permit frame arm pivoting about the straddle shafts, and so that when the desired frame arm angle is achieved, the straddle nuts may be again screwed tight to bring the clutch surfaces and the clutch disks into engaging mutual abutment. The straddle nut preferably has an elongate exterior to function as a handle for the user to grip while rotating the given the straddle nut. The clutch surface and the clutch disk each have engaging surfaces configured to define coaxially centered radial undulations so that the crest of each of the undulations on the given clutch disk fits engagingly into a valley of an undulation in the opposing the clutch surface; so that firm abutment of each clutch surface and the corresponding clutch disk prevents relative rotation of the clutch disks and clutch surfaces, because an abutting side of each valley blocks rotational movement of the adjacent opposing crest.

Each frame arm preferably includes two telescoping inner and outer arm tubes, each outer arm tube forming the rearward segment of each frame arm and being connected at the outer arm tube rearward end to the adjacent arm straddle through one of the clutch pivot joints, and the corresponding inner arm tube forms the forward segment of each frame arm and the inner arm tube forward end. The apparatus preferably additionally includes a set screw extending through a threaded port in the forward end of each outer arm tube for screwing against the corresponding inner arm tube to releasibly fix the extension of each frame arm.

The apparatus preferably additionally includes a deck mounting assembly interconnecting the deck and the frame arms. The deck mounting assembly preferably includes a deck cylinder extending between the forward ends of the frame arms and connected to the deck, the deck cylinder including a deck axle secured to and extending axially and longitudinally outward from the deck cylinder; a deck axle port in the forward end of each frame arm receiving and passing one of the deck axles; and a deck cylinder clutch mechanism for releasibly securing the deck cylinder and the connected deck against rotation about the longitudinal axis of the deck cylinder relative to the frame arms.

The deck cylinder clutch mechanism preferably includes a cylinder clutch engaging surface on each longitudinal end of the deck cylinder; a frame arm clutch engaging surface on each frame arm forward end adjacent to the frame arm port directed toward the deck cylinder; external threads on the deck axles; and a deck axle nut sized to screw onto the threads on each deck axle; so that each frame arm port is fitted over the corresponding and adjacent deck axle and a deck axle nut is screwed onto each deck axle to bring the corresponding frame arm clutch engaging surface into engaging contact with the corresponding cylinder engaging surface, thereby inhibiting relative rotation between the deck cylinder and the frame arms about the deck cylinder longitudinal axis.

The apparatus preferably additionally includes at least one spacer tube for fitting around one of the deck axles between the deck cylinder and the corresponding frame arm forward end for positioning the frame arms a greater lateral distance apart from each other to correspond to the lateral spacing between chair arms of chairs having a wider spacing than the length of the deck cylinder; the at least one spacer tube having spacer tube clutch engaging surfaces at each spacer tube longitudinal end for engaging the cylinder clutch engaging surface and the corresponding frame arm clutch engaging surface.

The spacer tube clutch engaging surface, and the cylinder clutch engaging surface and the frame arm clutch engaging surface are each preferably configured as surface undulations extending radially from the longitudinal axis of the deck cylinder; so that the crests of the undulations of one clutch engaging surface fit into the valleys of an opposing and adjacent clutch engaging surface which laterally abuts each crest and thereby prevents relative rotation between the clutch engaging surfaces. The apparatus preferably includes several the spacer tubes of various different lengths for setting the lateral spacing of the frame arms for a variety of different chair lengths.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
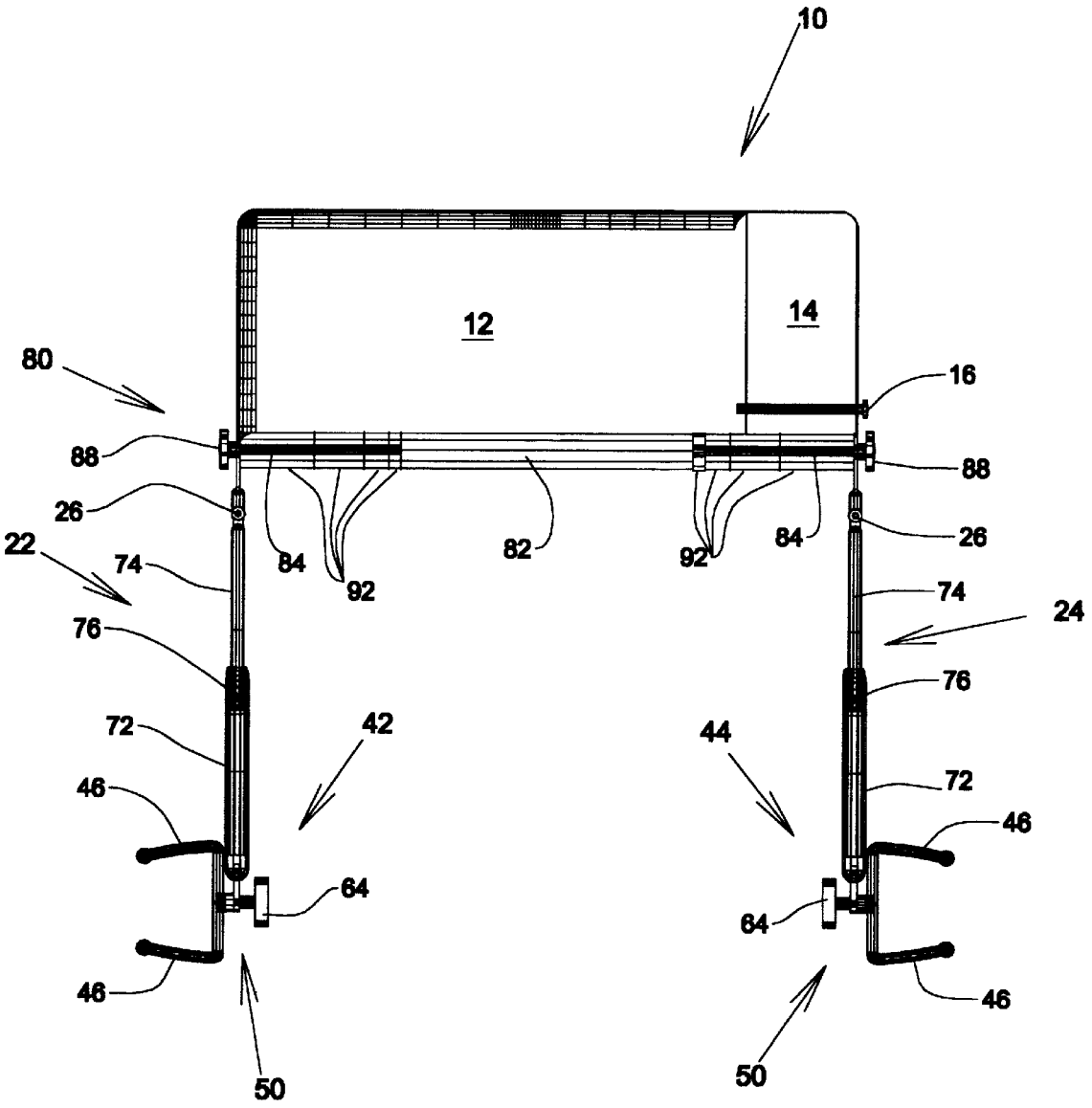
FIG. 1 is a top view of the inventive apparatus, showing the various essential elements.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
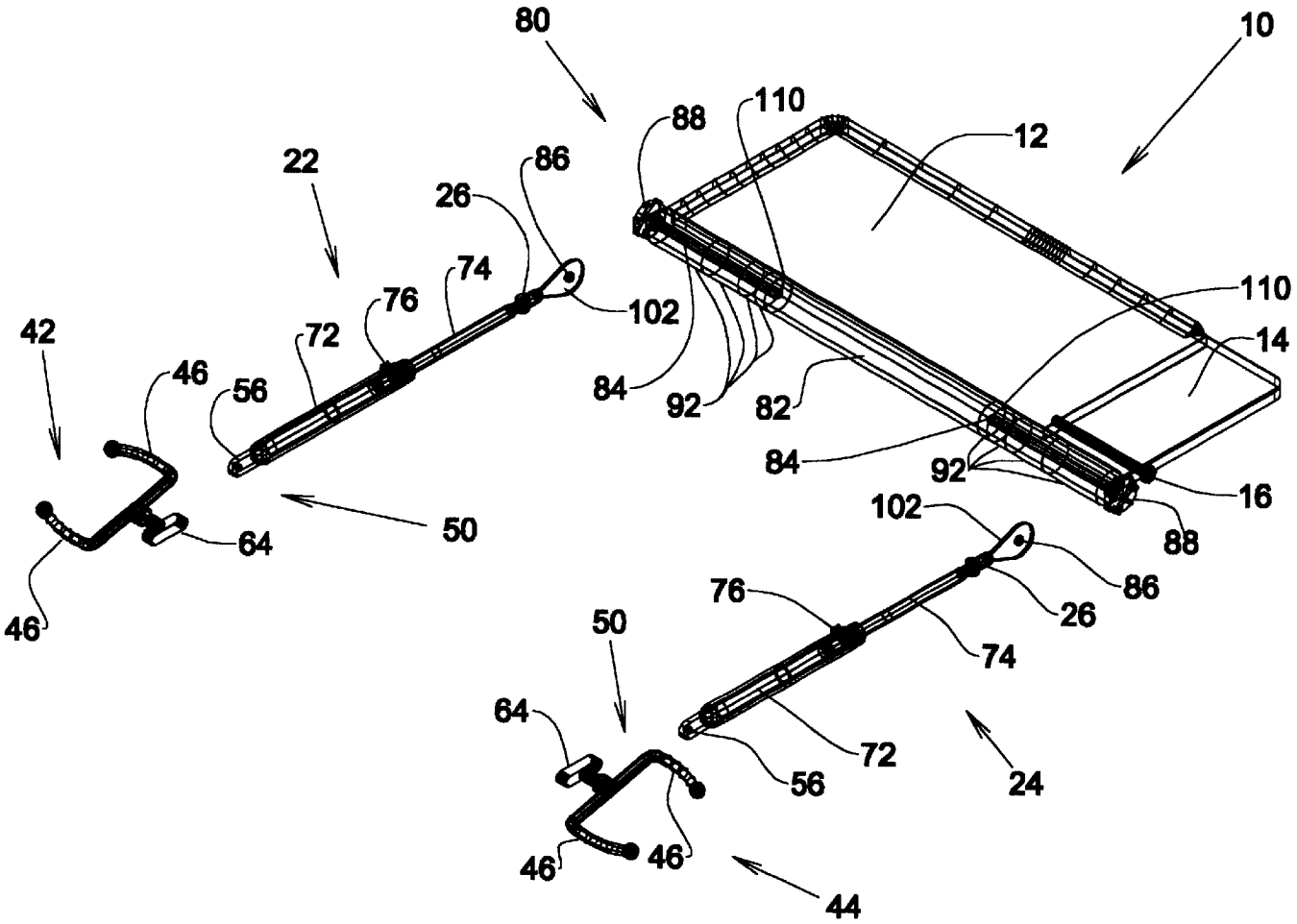
FIG. 2 is a perspective exploded view of the apparatus, separating the general elements of the apparatus and revealing the connection ports in the ends of the frame arms.
Figure 3:
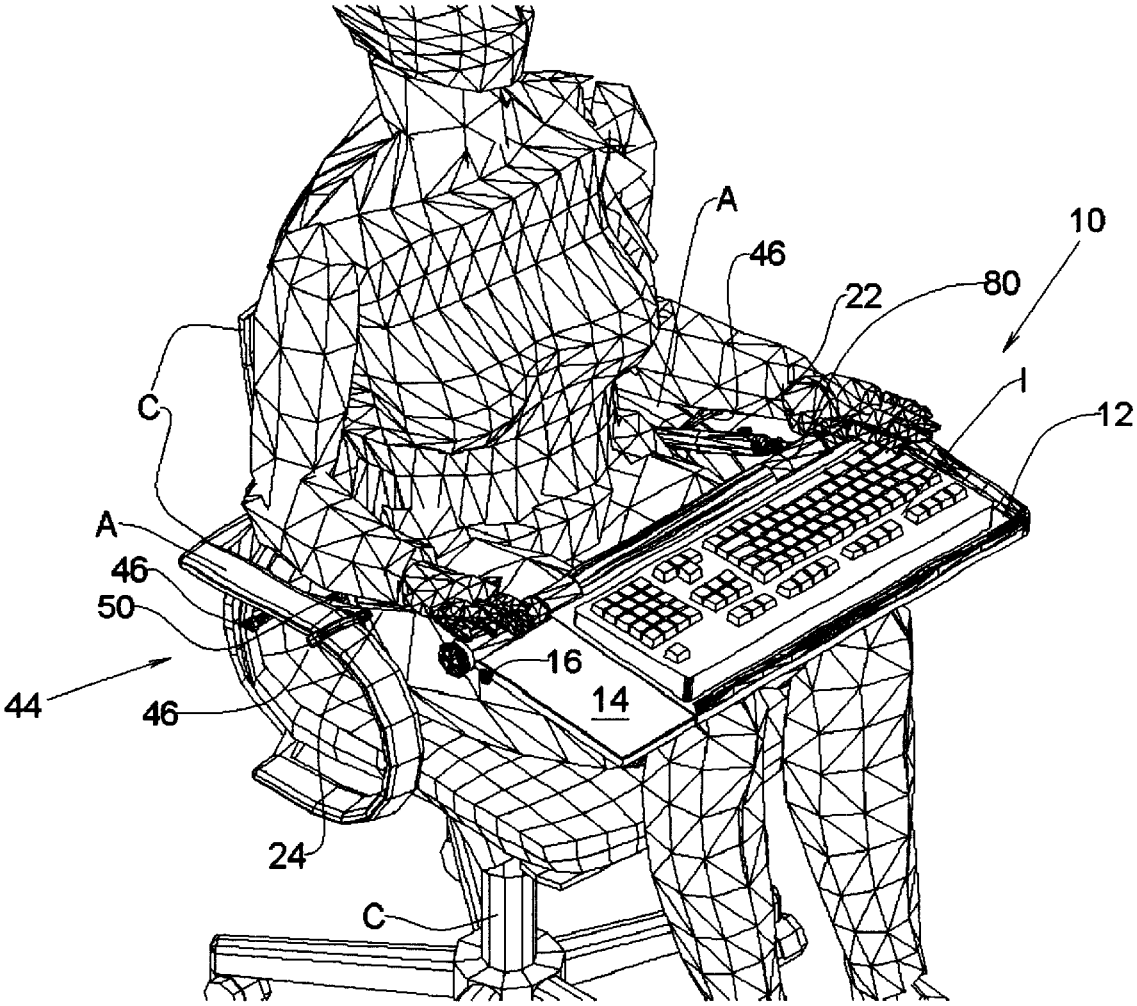
FIG. 3 is a perspective view of the apparatus mounted on a chair and supporting a computer keyboard, with a user seated in the chair and using the keyboard.
Figure 4:
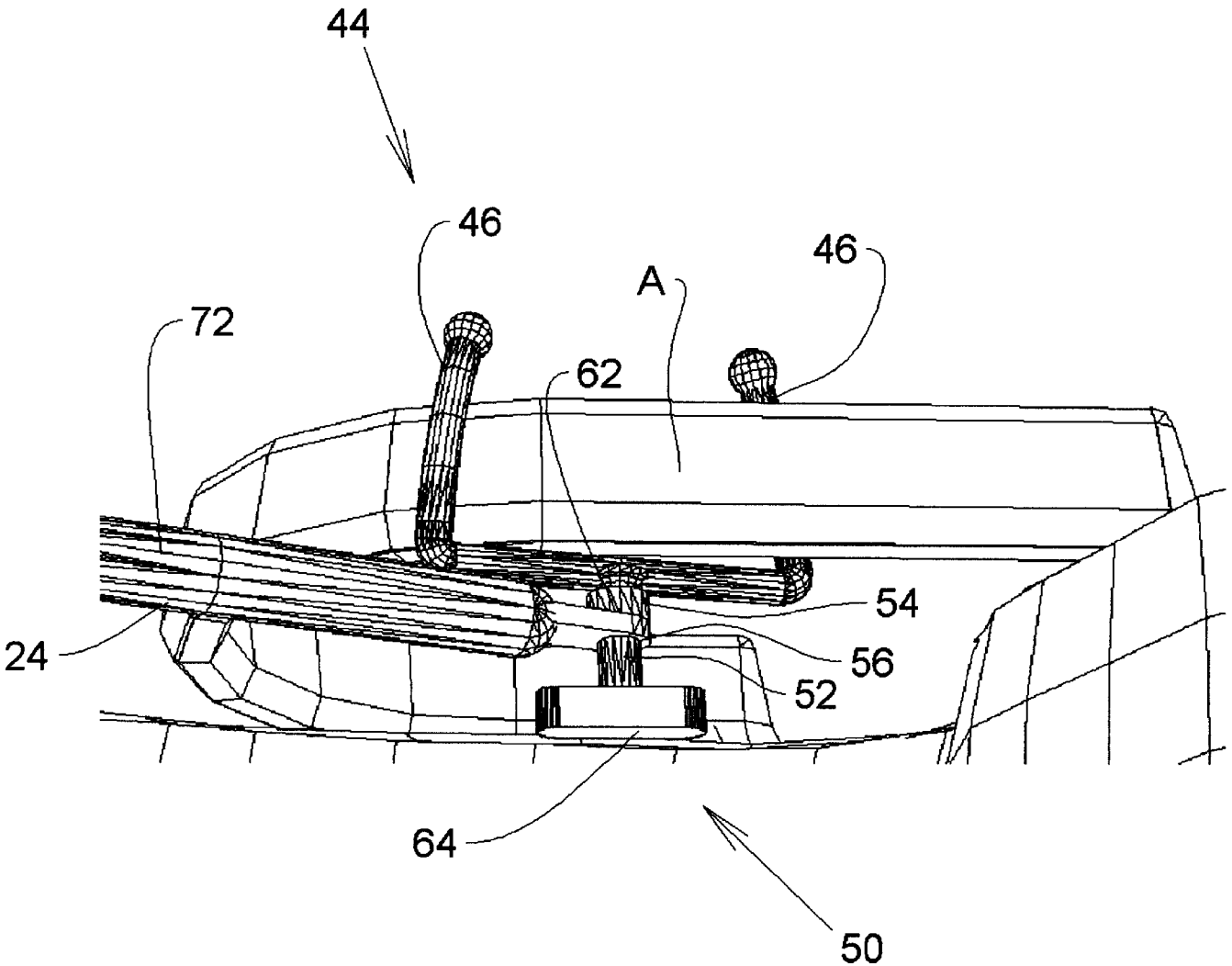
FIG. 4 is a close-up, broken away view of one of the arm straddles and the rearward end of a frame arm, the arm straddle shown engaging a chair arm.
Figure 5:
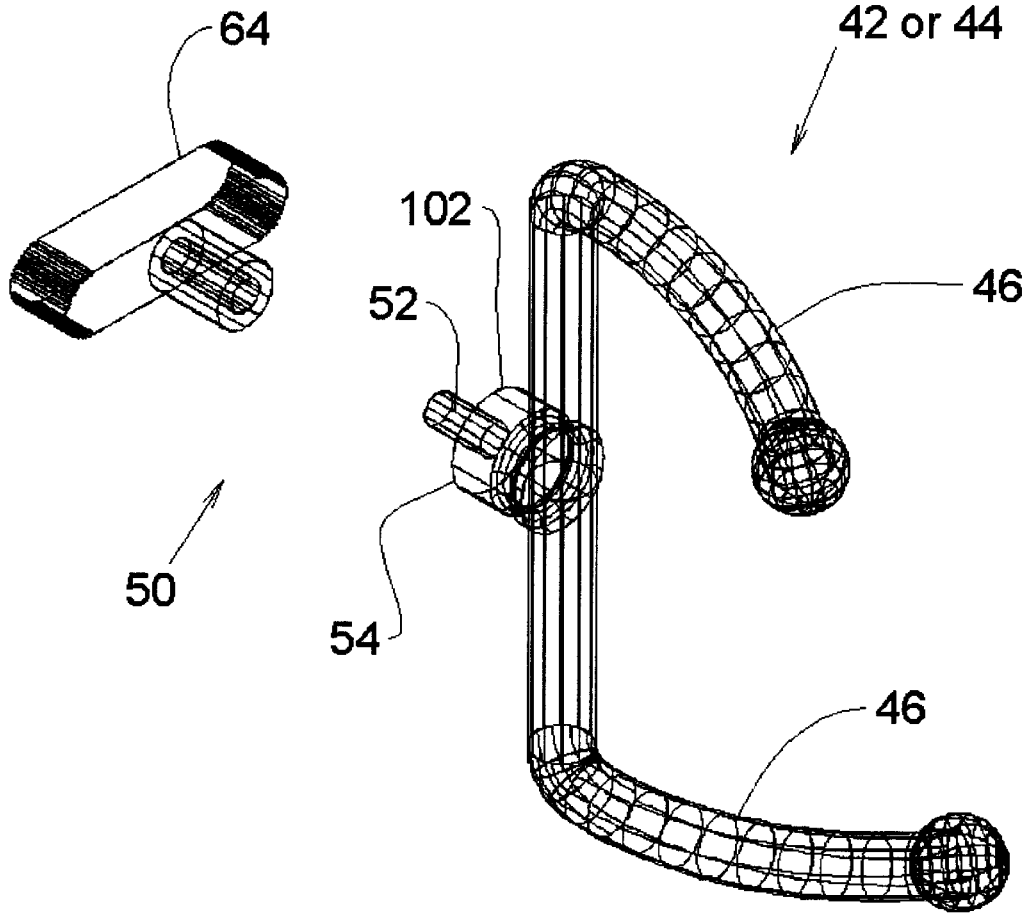
FIG. 5 is a perspective view of one of the arm straddles with the straddle nut removed and positioned for engagement.
Figure 6:
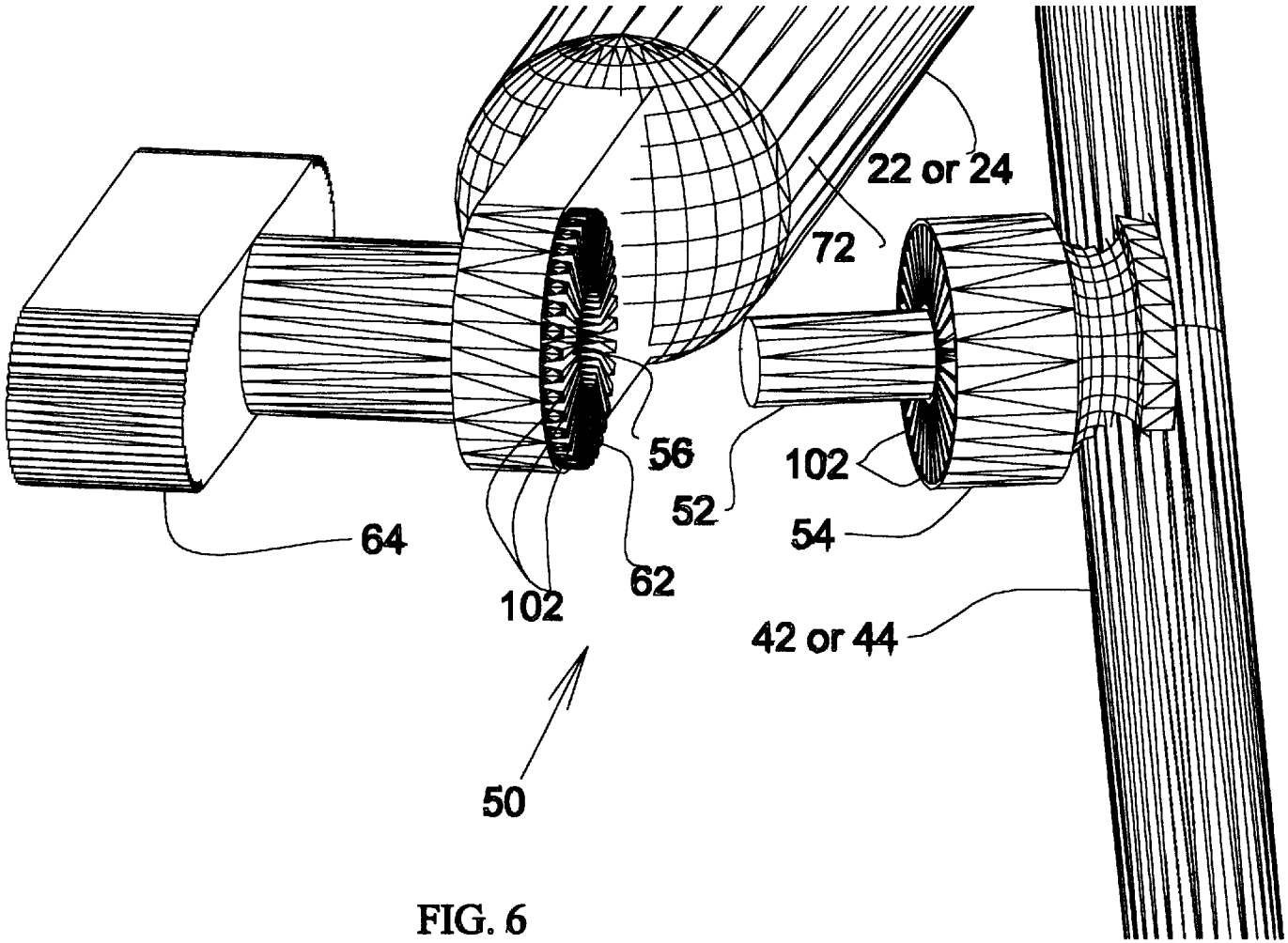
FIG. 6 is a close-up, perspective view of the preferred radial undulations of the clutch surfaces, in this instance of the clutch surfaces of one of the arm straddles, rearward end of a frame arm and a separated straddle nut.
Figure 7:
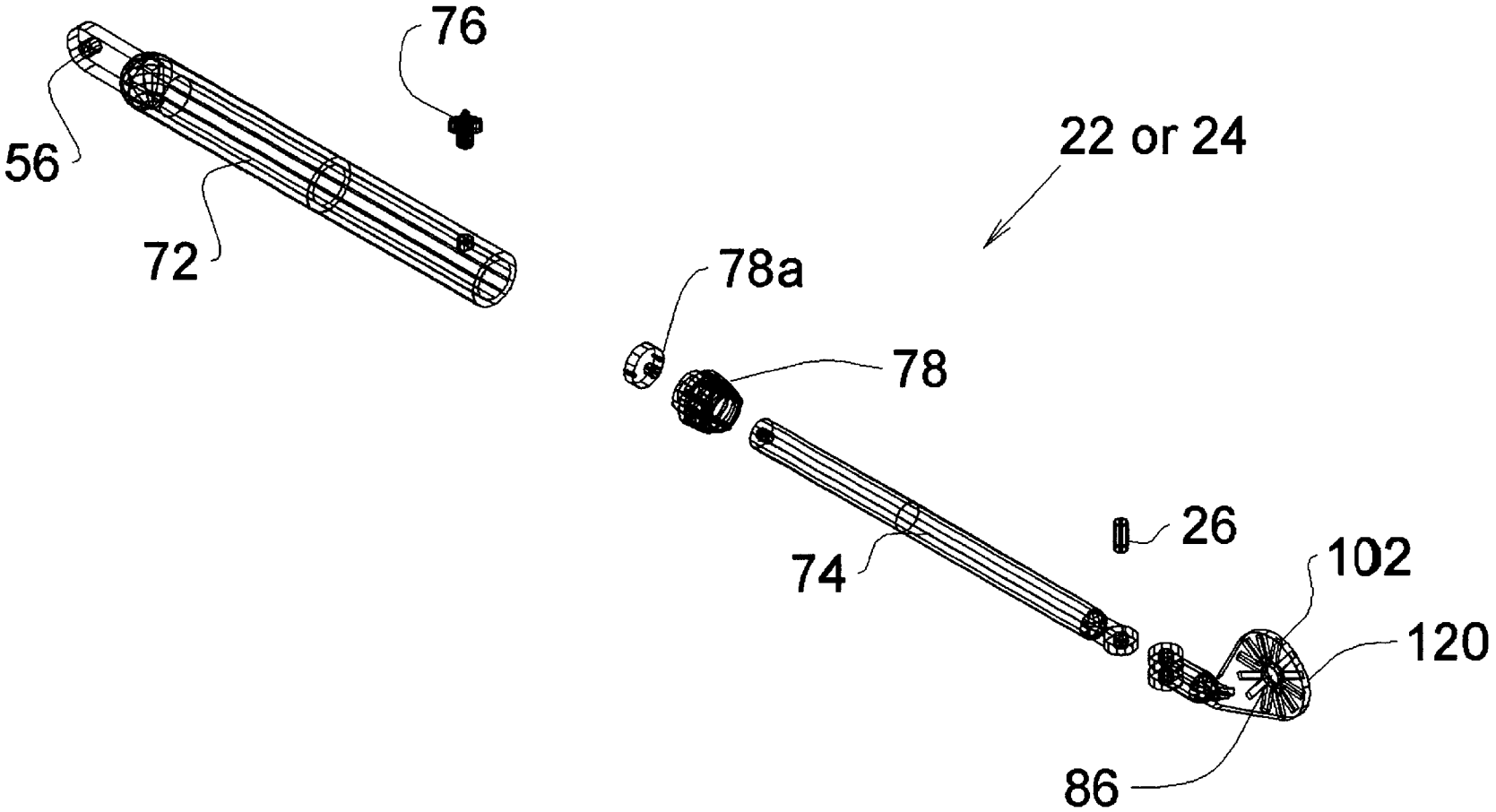
FIG. 7 is an exploded, perspective view of one of the frame arms, showing the various elements making up each frame arm.
Figure 8:
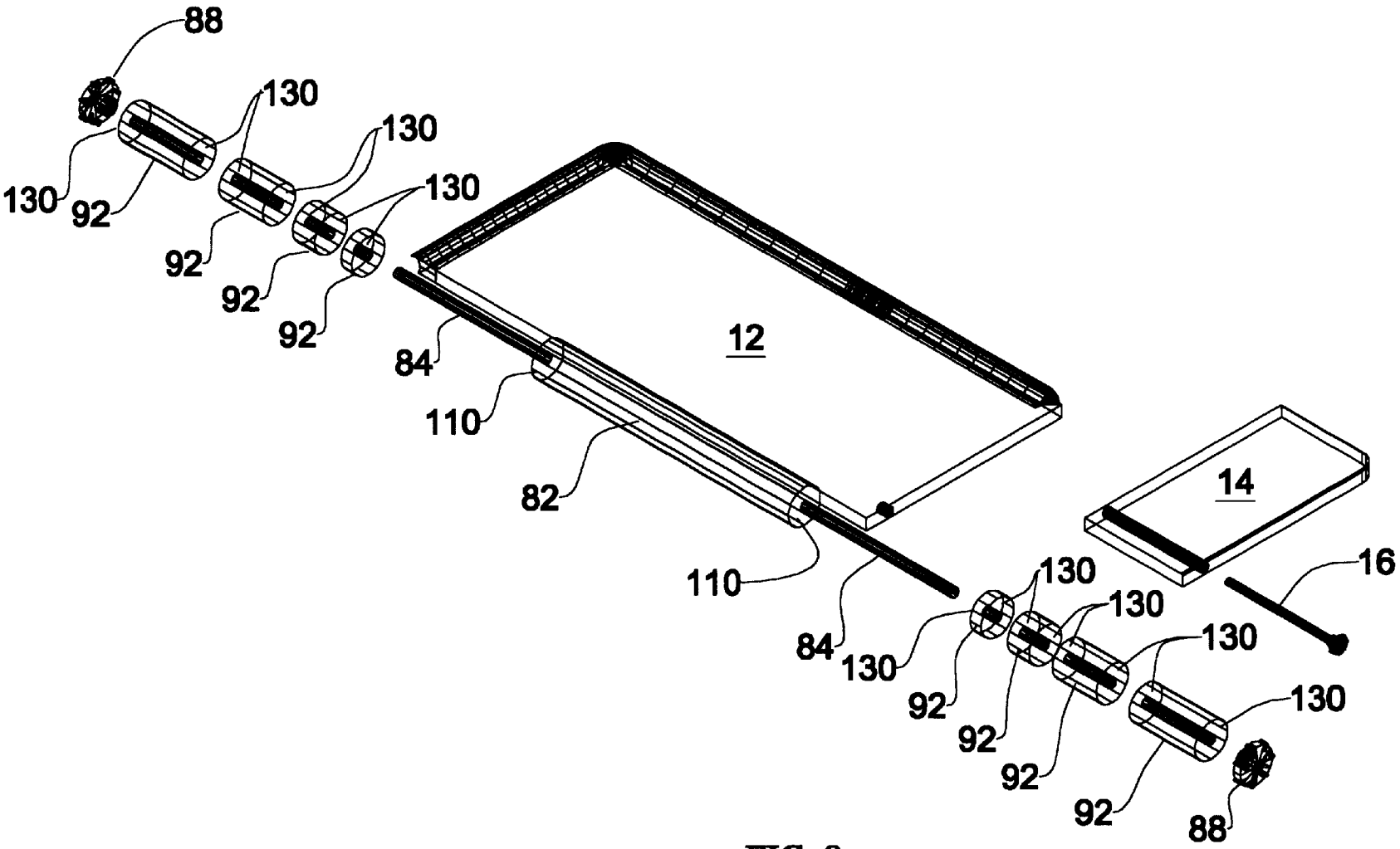
FIG. 8 is an exploded, perspective view of the preferred deck mounting assembly, showing the deck cylinder, deck axles, and spacer tubes.
Figure 9:
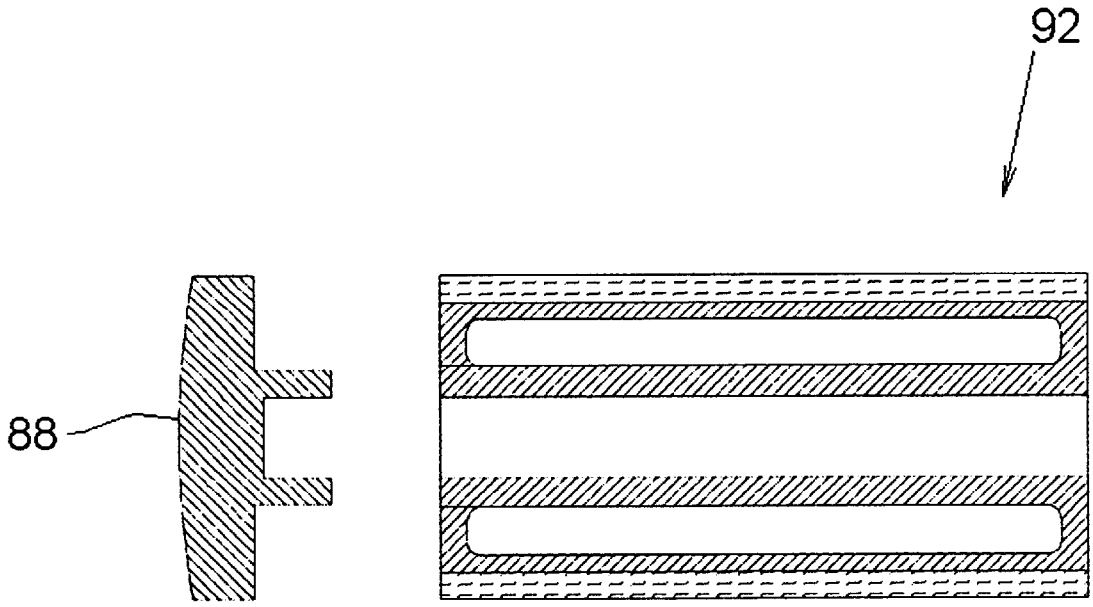
FIG. 9 is a cross-sectional side view of one of the spacer cylinders, showing the preferred internal construction which leaves voids to make the apparatus lighter in weight.

Referring to FIGS. 1–9, a chair arm-mounted tray apparatus 10 for supporting an item I such as a keyboard in front of a user seated on a chair is disclosed. The supported item I may be a keyboard, a mouse pad a laptop computer, and alternatively a book or a pen and paper.

Tray apparatus 10 includes a panel defining a support deck 12 on which the item I is placed and a deck support frame 20 fastened to deck 12, the deck support frame 20 having chair arm engaging means 40 which removably secures apparatus 10 to the arms A of a chair C. See FIGS. 1, 2 and 3. Deck support frame 20 positions the deck 12 forwardly of the chair C at an adjustable height and distance from the user and at an adjustable orientation relative to horizontal for ergonomic positioning of user arms and hands while the user operates a computer keyboard or mouse resting on deck 12. Deck 12 preferably includes a deck side pivot section 14 pivotally mounted on a pivot section axle 16 and secured in position with clutch means.

Deck support frame 20 includes parallel and laterally spaced apart telescoping frame arms 22 and 24, respectively, removably secured to chair arms A by chair arm engaging means 40. The chair arm engaging means 40 preferably takes the form of first and second arm straddles 42 and 44, respectively, each including a U-shaped member defining a pair of spaced-apart arm straddle tines 46. See FIGS. 4 and 5. The straddle tines 46 fit around each chair arm A, pointing outwardly from the middle of the chair C and having spherical tips. Tines 46 preferably arch in opposing directions to engage chair arms A with a greater mechanical advantage in the form of increased leverage. As the frame arms 22 and 24 pivot downwardly with their own weight as well as with the weight of the deck 12 and supported item I, the tines 46 rotate into abutting contact with the upper and lower surfaces of each chair arm 14, stopping further frame arm 22 and 24 downward pivoting, thus supporting frame arms 22 and 24 and deck 12 as the frame arms 22 and 24 project forwardly and upwardly from the seat of the chair C. Each arm straddle 42 and 44 includes a clutch pivot joint 50 at which the arm straddle 42 or 44 engages the corresponding frame arm 22 or 24, respectively.

The clutch pivot joints 50 each include a threaded straddle shaft 52 extending toward the opposing arm straddle 42 or 44 and a straddle clutch disk 54 facing toward the opposing arm straddle 44 or 42. Each frame arm 22 and 24 has a chair arm end in the form of a metal strip having a shaft port 56 for receiving and passing the adjacent straddle shaft 52 and a clutch surface facing the straddle clutch disk 54. A straddle nut 64, having an elongate body to function as a handle for the user to grip while rotating the nut 64, is screwed onto the threaded straddle shaft 52 until the chair end frame arm clutch surface 62 firmly abuts and engages the straddle clutch disk 54, preventing relative rotation between the frame arms 22 and 24 and the arm straddles 42 and 44. The angle of the frame arms 22 and 24 relative to horizontal can be adjusted as needed by the user by loosening straddle nuts 64 enough that the clutch surface 62 and clutch disk 54 of each arm straddle 42 and 44 disengage to permit frame arms 22 and 24 to pivot about the straddle shafts 52. When the desired frame arm angle is achieved, the straddle nuts 64 are again screwed tight to bring the clutch surfaces 62 and clutch disks 54 into engaging abutment.

It is preferred that the clutch surface 62 and clutch disk 54 each have engaging surfaces configured as radial undulations 102 so that the crest of each undulation 102 on the clutch disk fits engagingly into the valley of each corresponding undulation 102 in the opposing clutch surface 62. See FIG. 6. The undulations 102 preferably have the planar sides, sharp crest and valleys or spur gear teeth. Firm abutment of the clutch surface 62 and the clutch disk 54 prevents relative rotation of the clutch disk 54 and clutch surface 62, because an abutting side of each undulation 102 valley blocks rotational movement of the contained opposing undulation 102 crest. Alternatively, use of many other well-known clutch mechanisms are contemplated.

As mentioned above, each frame arm 22 and 24 is a telescoping pair of inner and outer arm tubes. See FIG. 7. The outer arm tube 72 forms the rearward segment of each arm 22 and 24 and is connected at the outer arm tube 72 rearward end to the adjacent arm straddle 42 or 44 through the clutch pivot joint 50. The inner arm tube 74 forms the forward segment of each arm 22 and 24 and the inner arm tube 74 forward end connects to a deck mounting assembly 80, and includes a ferrule 78 secured to its rearward end with a ferrule screw/plug 78*a*. A set screw 76 extends through a threaded port in the forward end of each outer arm tube 72 for screwing against the associated inner arm tube 74 to releasibly fix the extension of each frame arm 22 and 24.

The deck 12 includes the deck mounting assembly 80, which takes the form of a deck axle structure including a solid deck cylinder 82 molded as part of or affixed to the deck 12. See FIG. 8. The deck cylinder 82 has a deck axle 84 embedded axially into each cylinder 82 longitudinal end and extending axially and longitudinally outward from the cylinder 82. Each frame arm 22 and 24 forward end has a deck axle port 86 for receiving and passing one of the deck axles 84. For chairs C having narrowly spaced apart chair arms A, the spacing provided by the deck cylinder 82 is sufficient to space the frame arms 22 and 24 to match the lateral spacing of the chair arms A so that the frame arms 22 and 24 extend from the chair arms A substantially parallel to each other. For chairs C having chair arm A spacing wider than the length of the deck cylinder 82, spacer tubes 92 of various lengths are provided to fit around each axle 84 between the deck cylinder 82 and the adjacent frame arm 22 or 24, and a spacer tube 92 or spacer tubes 92 of a suitable length or composite length are selected to place the forward ends of the frame arms 22 and 24 a distance apart substantially matching the lateral separation of the chair arms A, so that the frame arms 22 and 24 once again extend forwardly substantially parallel to each other when fitted onto the deck axles 84. See FIG. 9.

Cylinder end clutch means 110 and arm side clutch means 120 are provided so that the deck cylinder 82 and frame arms 22 and 24 engage each other against relative rotation when in firm mutual abutment. The spacer tubes 92 each also have spacer tube end clutch means 130 to engage the cylinder 82, another spacer tube 92 or the frame arm 22 or 24, whichever is in abutment with the spacer tube 92 end, against relative rotation when in firm abutment with the cylinder 82, adjacent spacer tube 92 or frame arm 22 or 24, respectively.

The cylinder end clutch means 110 and spacer tube end clutch means 130 are each preferably a cylinder 82 or spacer tube 92 end surface, respectively, having radial undulations 102, as described above for the clutch pivot joint 50. The undulations 102 mesh, as described above, when brought into firm longitudinal abutment. The forward frame arm side clutch means 120 preferably includes a forward frame arm clutch surface 122 having radial undulations 102 which once again meshes with the undulations 102 of the either the adjacent cylinder 82 or spacer tube 92 undulations 102 as described above when in firm abutment to prevent relative rotation. To produce the necessary firm abutment between all undulating clutch surfaces in series along the deck mounting assembly 80, the ends of the axles 84 are preferably threaded and an axle clutch nut 88 is screwed onto each axle 84 and into firm abutment with the forward end of each frame arm 22 or 24. The axle clutch nut 88 is preferably of the configuration described above for the clutch pivot joint 50. Any unneeded spacer tubes 92 are placed around the axles 84 between the forward frame arm 22 and 24 ends and the axle clutch nuts 88 so that they remain affixed to the apparatus 10 against any possibility of loss.

The arm straddles 42 and 44 are preferably C-shaped as described above, and where the chair arms A are elongate members the arm straddles preferably are oriented to open laterally to fit around the arm members. Where the chair arms A are solid walls, downward opening clamps (not shown) are provided to fit and clamp around the arm A upper ends.

Second Preferred Embodiment

A second embodiment of apparatus 10 is contemplated in which only one frame arm 22 is provided. Either the deck pivots on the frame arm 22 about a substantially vertical axis on a dowel 26 extending through ends of a break in the frame arm 22 near the deck 12, or the frame arm 22 pivots at the arm straddle 42 about a substantially vertical axis, to permit moving the deck 12 out of the way of a user wishing to rise from the chair C, and to permit moving the deck 12 back in front a user when the user again sits in the chair C, without need of removing apparatus 10 from chair C.

Third Preferred Embodiment

Figure 10:
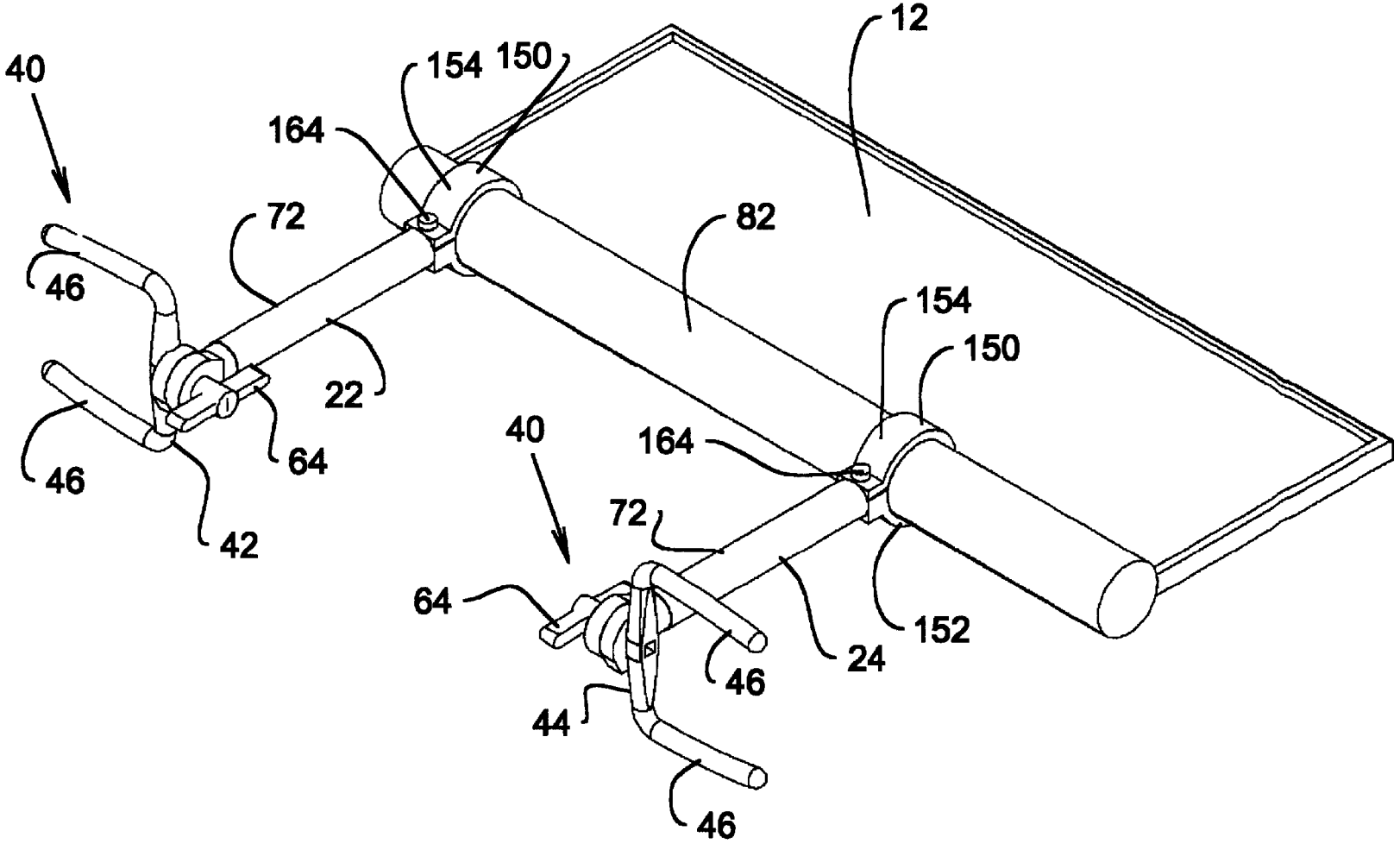
FIG. 10 is a top perspective view of the third embodiment of the apparatus, having the cylinder clamps at the ends of the frame arms.
Figure 11:
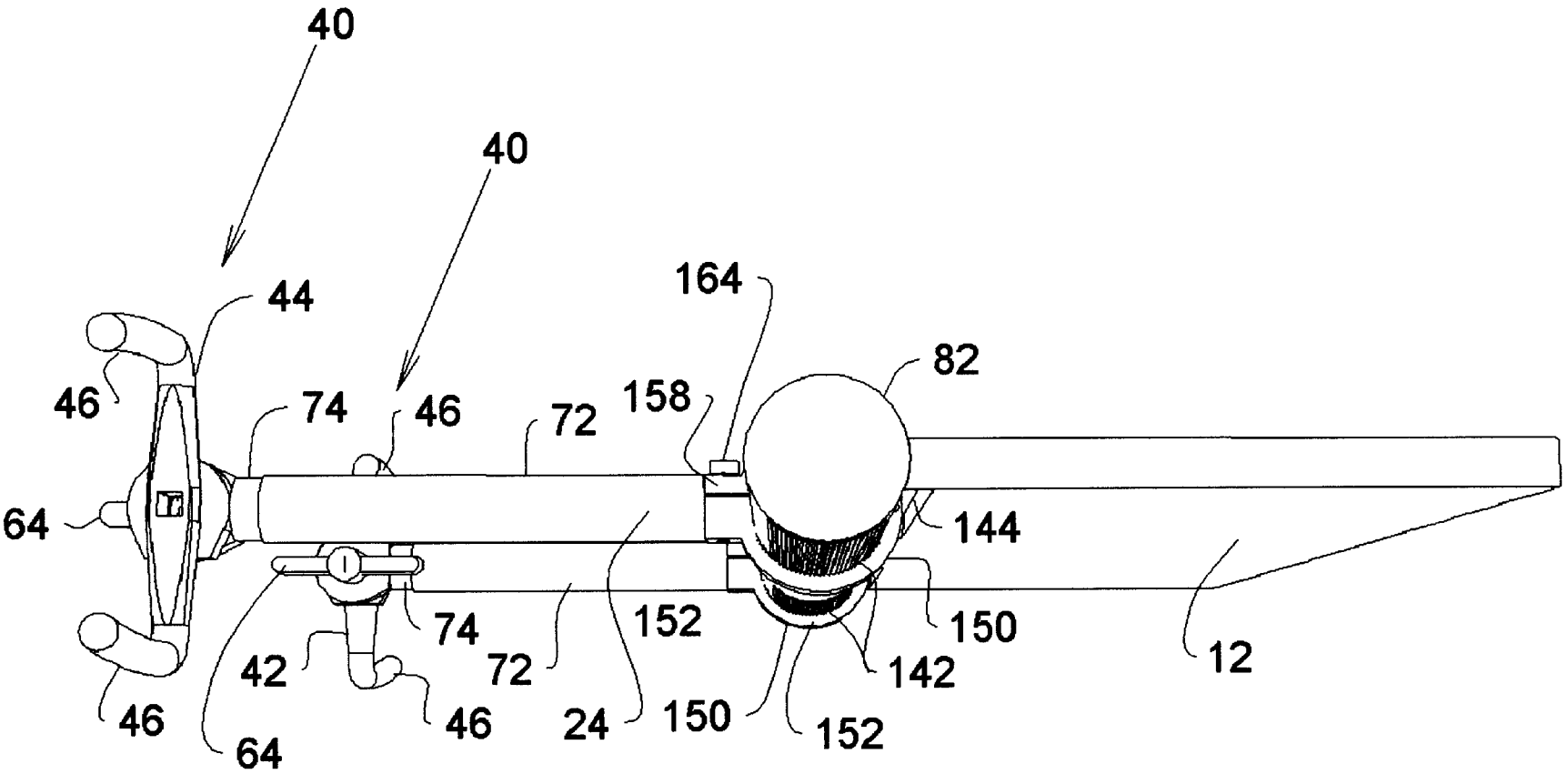
FIG. 11 is a bottom perspective view of the apparatus of FIG. 10.
Figure 12:
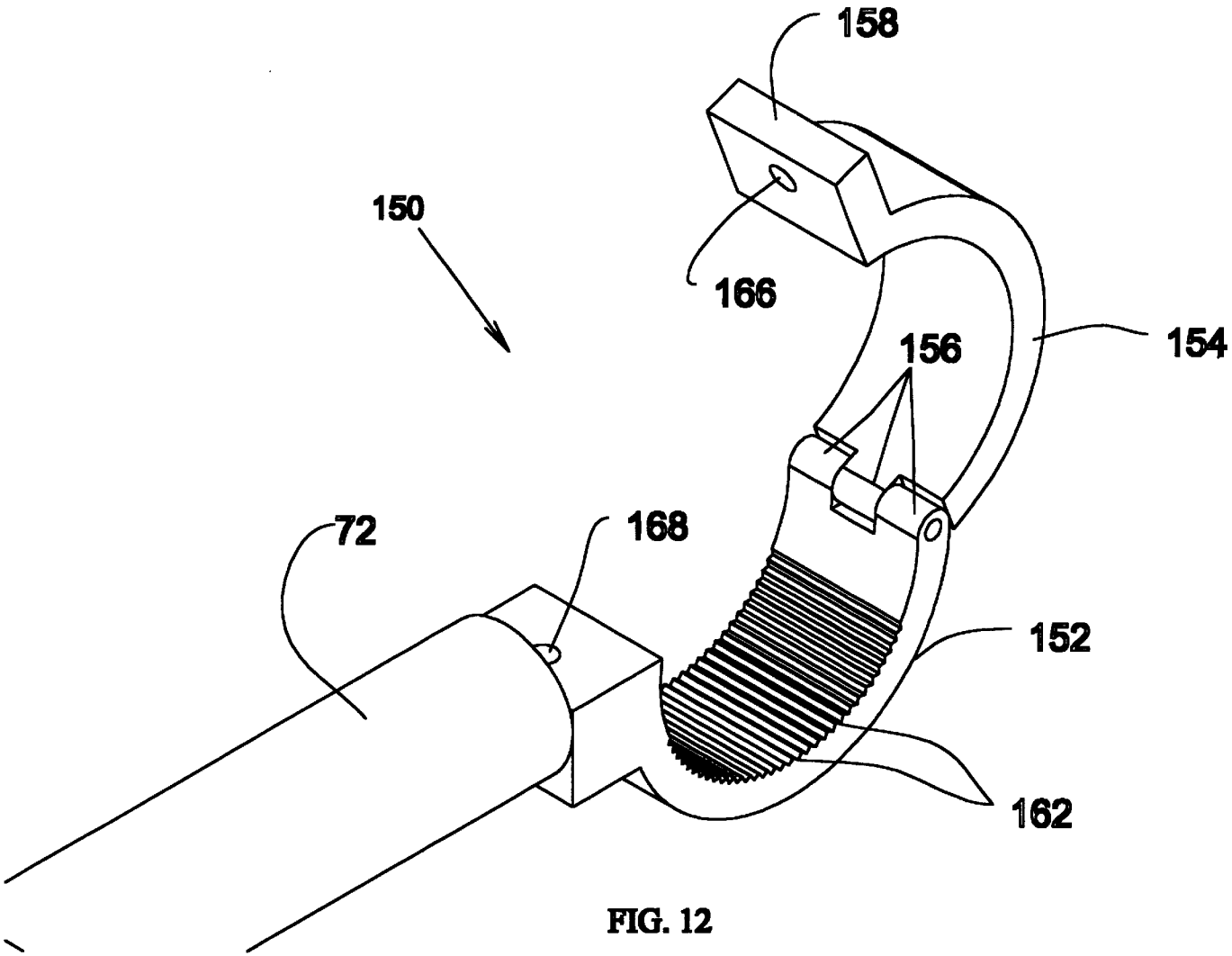
FIG. 12 is a partial perspective view of one frame arm and clamp of FIG. 10, with the clamp shown open.
Figure 13:
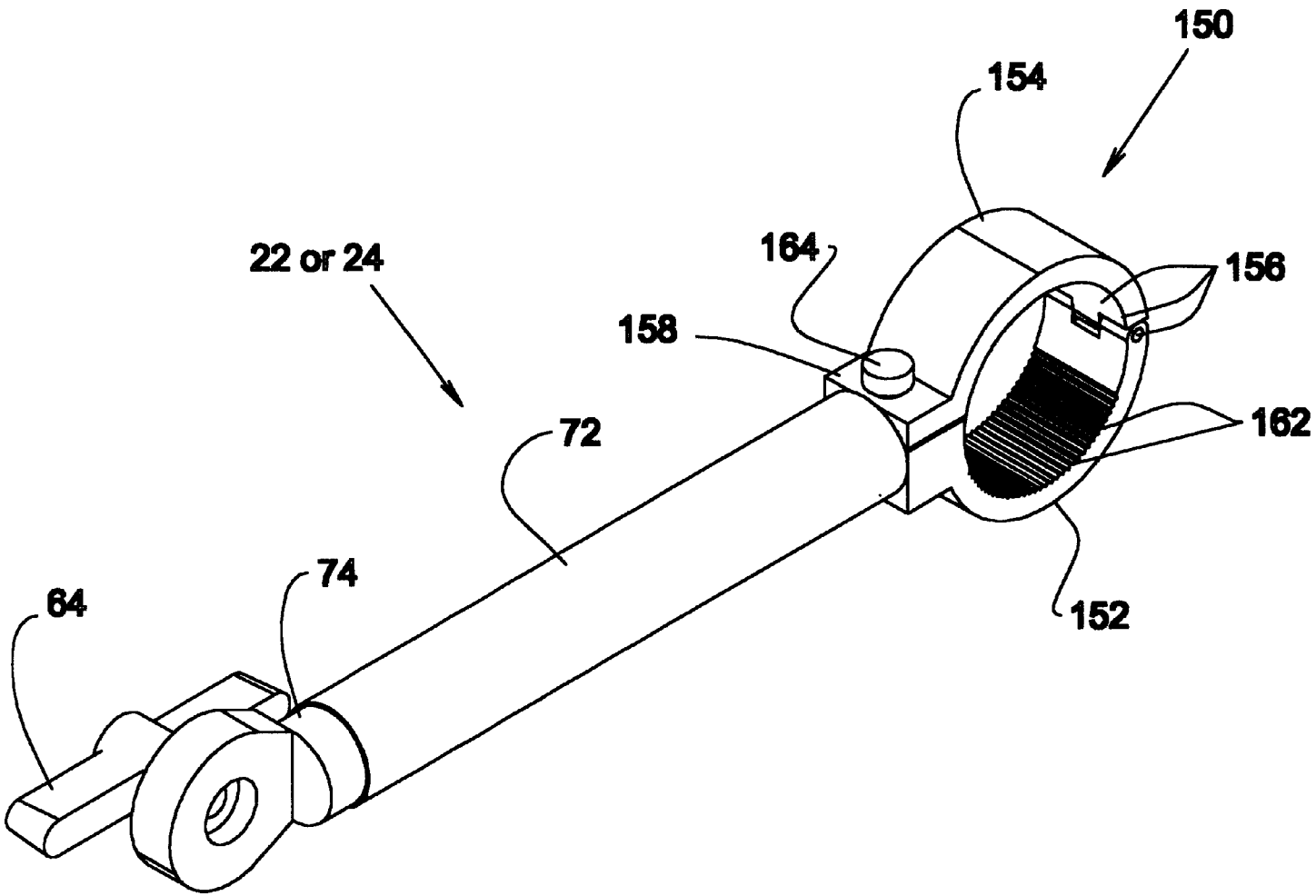
FIG. 13 is a full perspective view of one frame arm and clamp of FIG. 10, with the clamp shown closed.
Figure 14:
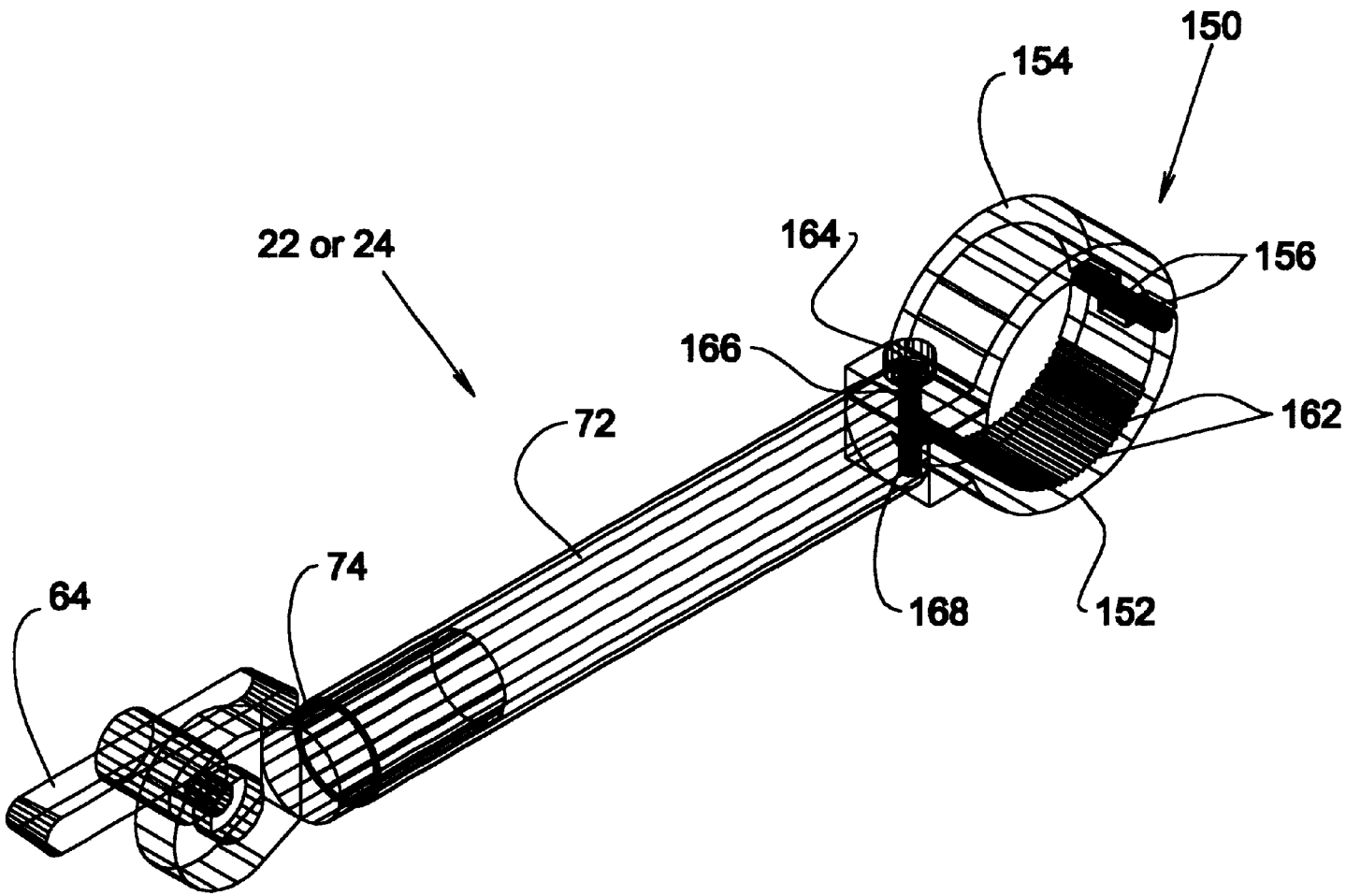
FIG. 14 is a view as in FIG. 13, showing the frame arm and clamp as though it were transparent, revealing hidden lines.

The third embodiment is like the first except that the deck mounting assembly 80 is altered. See FIGS. 10–14. The deck cylinder 82 does not having axle ports, and deck axles 84 are omitted. Instead, deck cylinder 82 releasibly engaged by cylinder clamps 150 secured to frame arm 22 and 24 ends. A clamp passing slot 144 is provided at each end of cylinder 82, separating cylinder 82 from deck 12 so that clamps 150 can slide onto opposing ends of cylinder 82 within slots 144.

Each clamp 150 includes a generally U-shaped fixed arc portion 152 fixedly joined or molded as part of the frame arm 22 or 24 and preferably opening upwardly. A generally U-shaped pivoting arc portion 154 is attached to the free end of fixed arc portion 152 with clamp hinges 156. Arc portions 152 and 154 each have semicircular inner surfaces and close together on hinges 152 to form a circular tube segment sized to closely receive cylinder 82. Each pivoting arc portion 154 has a clamp locking flange 158 protruding from its free end. A clamp locking screw 164 passes through a port 166 in locking flange 158 and removably screws into a threaded bore 168 in frame arm 22 or 24 free end.

Cylinder 82 preferably is provided with longitudinal grooves 142 along its outer surface. Corresponding groove engaging ridges 162 are provided in one or both arc portion inner surfaces to engage grooves 142 and thereby secure cylinder 82 against axial rotation relative to frame arms 22 and 24, so that deck 12 does not pivot downwardly under the weight of a keyboard, laptop or other item resting on its upper surface.

Locking screw 164 is screwed through port 166 and into bore 168 to secure the clamp 150 around cylinder 82. Locking screw 164 is unscrewed to release pivoting arc portion 154 to pivot away from fixed arc portion 152 and thereby to open the clamp 150 to release cylinder 82 and the connected deck 12. Once again, frame arms 22 and 24 are preferably each made up of a pair of first and second telescoping tubes 72 and 74 so that deck 12 can be extended away from the seated user, and brought toward the seated user, to an optimum position for user comfort. The distance between of the two frame arms 22 and 24 can be altered for chairs of differing arm separation by loosening one or both of the clamps 150 and sliding them along deck cylinder 82 to appropriate locations, and then re-securing clamps 150 onto cylinder 82. This embodiment has the advantages of increased simplicity, lower cost and ease of use.

For all embodiments of the present apparatus 10, it is contemplated as an option that a structure of interconnecting members extend between and connect the two frame arms 22 and 24 to hold them in a fixed spacial relation with each other. This structure (not shown) would keep the frame arms 22 and 24 mutually parallel and otherwise correctly positioned. The coverage of the claims is understood to be for the apparatus 10 with or without this interconnection structure.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A tray apparatus for mounting on a chair having a chair seat and having chair arms spaced above the chair seat, comprising:

an item support deck for supporting an item;

a deck support frame fastened to said support deck, said deck support frame having chair arm engaging means for removably securing said apparatus to the arms of a chair, said deck support frame comprising two parallel and laterally spaced apart frame arms removably secured to the chair arms by said chair arm engaging means, said frame arms each having a frame arm forward end adjacent to said deck and a frame arm rearward end adjacent to the chair;

such that said deck support frame positions said deck forwardly of the chair at an adjustable height and at an adjustable orientation relative to horizontal;

and a deck mounting assembly interconnecting said deck and said frame arms, said frame arm forward ends slidably engaging said deck mounting assembly such that said frame arm forward ends are laterally mobile along said deck mounting assembly and relative to said deck for altering the spacing between said frame arms to correspond to spacing between the chair arms of a chair.

2. The apparatus of claim 1, wherein said parallel and laterally spaced apart frame arms are telescoping frame arms.

3. A tray apparatus for mounting on a chair having a chair seat and having chair arms spaced above the chair seat, comprising:

an item support deck for supporting an item;

a deck support frame fastened to said support deck, said deck support frame having chair arm engaging means for removably securing said apparatus to the arms of a chair;

such that said deck support frame positions said deck forwardly of the chair at an adjustable height and at an adjustable orientation relative to horizontal;

wherein said chair arm engaging means comprises first and second arm straddles, each configured as a substantially U-shaped member defining a pair of spaced apart straddle tines;

such that said straddle tines fit around each chair arm, facing generally outwardly from the middle of the chair, and such that said frame arms pivot downwardly with their own weight and the weight of said deck and thereby said tines rotate into abutting contact with upper and lower surfaces of each chair arm, stopping further frame arm pivoting and thus supporting said frame arms and said deck.

4. The apparatus of claim 3, wherein each of said first arm straddle and said second arm straddle comprises a clutch pivot joint at which said first arm straddle engages an adjacent said frame arm and wherein said second arm straddle engages an adjacent said frame arm, each said clutch pivot joint comprising:

a threaded straddle shaft extending from said first arm straddle toward said second arm straddle and a straddle clutch disk facing toward said second arm straddle, and a threaded straddle shaft extending from said second arm straddle toward said first arm straddle and a straddle clutch disk facing toward said first arm straddle, each frame arm having a chair end comprising a shaft port for receiving and passing the adjacent said straddle shaft, and having a clutch surface facing the adjacent said straddle clutch disk;

and a straddle nut screwed onto each said threaded straddle shaft until the frame arm chair end clutch surface firmly abuts and engages the corresponding said straddle clutch disk, preventing relative rotation between each said frame arm and each of said first arm straddle and said second arm straddle;

such that the angle of said frame arms relative to horizontal can be adjusted as needed by the user by loosening the straddle nuts enough that said clutch surface and said clutch disk of each arm straddle disengages to permit frame arm pivoting about said straddle shafts, and such that when the desired frame arm angle is achieved, said straddle nuts may be again screwed tight to bring said clutch surfaces and said clutch disks into engaging mutual abutment.

5. The apparatus of claim 4, wherein each said straddle nut has an elongate exterior to function as a handle for the user to grip while rotating the given said straddle nut.

6. The apparatus of claim 4, wherein said clutch surface and said clutch disk each have engaging surfaces configured to define coaxially centered radial undulations such that the crest of each said undulation on the given said clutch disk fits engagingly into a valley of said undulations in the opposing said clutch surface;

such that firm abutment of each clutch surface and the corresponding said clutch disk prevents relative rotation of said clutch disks and clutch surfaces, because an abutting side of each said valley blocks rotational movement of the adjacent and opposing said crest.

7. The apparatus of claim 4, wherein each said frame arm comprises two telescoping inner and outer arm tubes, each said outer arm tube forming the rearward segment of each said frame arm and being connected at the outer arm tube rearward end to the adjacent said arm straddle through one of said clutch pivot joints, and the corresponding said inner arm tube forms the forward segment of each said frame arm and the inner arm tube forward end.

8. The apparatus of claim 7, additionally comprising a set screw extending through a threaded port in the forward end of each said outer arm tube for screwing against the corresponding said inner arm tube to releasibly fix the extension of each said frame arm.

9. The apparatus of claim 4, additionally comprising a deck mounting assembly interconnecting said deck and said frame arms.

10. The apparatus of claim 9, wherein said deck mounting assembly comprises:

a deck cylinder extending between the forward ends of said frame arms and connected to said deck, said deck cylinder comprising a deck axle secured to and extending axially and longitudinally outward from said deck cylinder;

a deck axle port in the forward end of each frame arm receiving and passing one of said deck axles;

and deck cylinder clutch means for releasibly securing said deck cylinder and the connected said deck against rotation about the longitudinal axis of said deck cylinder relative to said frame arms.

11. The apparatus of claim 10, wherein said deck cylinder clutch means comprises:

a cylinder clutch engaging surface on each longitudinal end of said deck cylinder;

a frame arm clutch engaging surface on each frame arm forward end adjacent to said frame arm port directed toward said deck cylinder;

external threads on said deck axles;

and a deck axle nut sized to screw onto the threads on each said deck axle;

such that each frame arm port is fitted over the corresponding and adjacent deck axle and a deck axle nut is screwed onto each deck axle to bring the corresponding said frame arm clutch engaging surface into engaging contact with the corresponding cylinder engaging surface, thereby inhibiting relative rotation between said deck cylinder and said frame arms about the deck cylinder longitudinal axis.

12. The apparatus of claim 11, additionally comprising:

at least one spacer tube for fitting around one of said deck axles between said deck cylinder and the corresponding said frame arm forward end for positioning said frame arms a greater lateral distance apart from each other to correspond to the lateral spacing between chair arms of chairs having a wider spacing than the length of said deck cylinder; said at least one spacer tube having spacer tube clutch engaging surfaces at each spacer tube longitudinal end for engaging said cylinder clutch engaging surface and the corresponding said frame arm clutch engaging surface.

13. The apparatus of claim 12, wherein said spacer tube clutch engaging surface, and said cylinder clutch engaging surface and said frame arm clutch engaging surface are each configured as surface undulations extending radially from the longitudinal axis of said deck cylinder;

such that the crests of the undulations of one said clutch engaging surface fit into the valleys of an opposing and adjacent said clutch engaging surface which laterally abuts each said crest and thereby prevents relative rotation between said clutch engaging surfaces.

14. The apparatus of claim 12, comprising a plurality of said spacer tubes of various different lengths for setting the lateral spacing of said frame arms for a variety of different chair lengths.

15. A tray apparatus for mounting on a chair having a chair seat and having chair arms spaced above the chair seat, comprising:

an item support deck for supporting an item;

a deck support frame fastened to said support deck, said deck support frame having chair arm engaging means for removably securing said apparatus to the arms of a chair;

such that said deck support frame positions said deck forwardly of the chair at an adjustable height and at an adjustable orientation relative to horizontal;

wherein said deck support frame comprises at least one telescoping frame arm removably secured to a chair arm by said chair arm engaging means, said frame arm having a frame arm forward end adjacent to said deck and a frame arm rearward end adjacent to the chair;

a deck mounting assembly interconnecting said deck and said frame arms comprising a deck cylinder extending between the forward ends of said frame arms and connected to said deck, said deck cylinder comprising a deck axle secured to and extending axially and longitudinally outward from said deck cylinder;

a deck axle port in the forward end of each frame arm receiving and passing one of said deck axles;

and deck cylinder clutch means for releasibly securing said deck cylinder and the connected said deck against rotation about the longitudinal axis of said deck cylinder relative to said frame arms;

cylinder protrusions extending radially outwardly from said deck cylinder;

wherein said deck and deck cylinder are joined together, additionally comprising:

a clamp secured to said arm forward end releasibly engaging said deck cylinder.

16. The apparatus of claim 15, additionally comprising:

a clamp passing slot between said deck and said deck cylinder.

17. The apparatus of claim 15, wherein said clamp comprises:

a generally U-shaped fixed arc portion having a fixed arc portion connected end fixedly joined to said frame arm and having a fixed arc portion free end;

a generally U-shaped pivoting arc portion hingedly connected to said fixed arc portion free end;

and locking means for releasibly locking said pivoting arc portion free end to said fixed arc portion connected end;

such that said deck cylinder and said deck are secured in a desired position by opening said clamp and fitting a segment of said deck cylinder into said fixed arc portion and pivoting said pivoting arc portion around said deck cylinder segment, and operating said locking means to lock said pivoting arc portion free end to said fixed arc portion connected end.

18. The apparatus of claim 17, additionally comprising:

cylinder protrusions extending radially outwardly from said deck cylinder;

and corresponding clamp indentations within said clamp for releasibly engaging said deck cylinder protrusions and thereby preventing said deck from pivoting relative to said frame arms.

19. The apparatus of claim 17, additionally comprising:

cylinder indentations extending radially outwardly from said deck cylinder;

and corresponding clamp protrusions within said clamp for releasibly engaging said deck cylinder indentations and thereby preventing said deck from pivoting relative to said frame arms.

* * * * *